US005407075A

United States Patent [19]

Descalzo

[11] Patent Number: 5,407,075

[45] Date of Patent: Apr. 18, 1995

[54] PACK FOR WEDGE-SHAPED FOOD

[75] Inventor: Jean-Claude Descalzo, Franconville, France

[73] Assignee: Compagnie Laitiere Europeenne, Conde-Sur-Vire, France

[21] Appl. No.: 131,717

[22] Filed: Oct. 5, 1993

[30] Foreign Application Priority Data

Oct. 5, 1992 [FR] France ..... 92 11797

[51] Int. Cl.[6] ..... A45C 11/20

[52] U.S. Cl. ..... 206/551; 229/87.08; 229/107; 229/115; 426/130

[58] Field of Search ..... 206/551; 426/130, 122, 426/123; 229/107, 115, 161, 87.08, 87.05

[56] References Cited

U.S. PATENT DOCUMENTS

| | | | |
|---|---|---|---|
| 1,599,267 | 9/1926 | Amos | 229/87.05 |
| 1,716,975 | 6/1929 | Phillips | 229/115 |
| 2,461,981 | 2/1949 | Hills | 426/130 |
| 3,322,322 | 5/1967 | Persson | 229/161 |
| 4,657,142 | 4/1987 | Mizoguchi et al. | 426/122 X |

FOREIGN PATENT DOCUMENTS

| | | | |
|---|---|---|---|
| 1005021 | 2/1977 | Canada | 229/115 |
| 748825 | 7/1933 | France | 229/115 |
| 1499339 | 9/1967 | France . | |

*Primary Examiner*—Bryon P. Gehman
*Attorney, Agent, or Firm*—Nawrocki, Rooney & Sivertson

[57] ABSTRACT

The invention relates to a pack for food, in particular cheese. The pack is obtained by folding and gluing a single blank, e.g. made of card. The blank comprises a wedge-shaped base zone which has two transverse cuts formed therein and which is connected to two rectangular lateral zones via respective first score lines. The ends of the cuts extend into the lateral zones and are interconnected within the lateral zones by respective second score lines. The zone between the two cut lines constitutes a strip that lies on top of the cheese once it has been inserted into the pack.

7 Claims, 1 Drawing Sheet

PACK FOR WEDGE-SHAPED FOOD

The present invention relates to a pack, in particular for food.

1. Field of the Invention

More precisely, the present invention relates to a pack providing partial or additional packaging for a product, in particular a food product, for the purpose of distributing it on sales surfaces. In other words, the present invention does not relate to fully packaging a product but to additional packaging serving to protect the product and improve its presentation to customers.

2. Background of the Invention

There exist foods, in particular cheeses sold in self-service stores, for which initial packaging has already been performed and where an additional problem exists of providing outer packaging that serves to protect the food mechanically while it is being handled and that also serves as attractive presentation means for the food, in particular to show the trademark under which it is sold, and also to show its leading qualities.

Another problem is that it is entirely desirable for the pack of the kind specified above to be as cheap as possible both with respect to the raw material used for making it and with respect to subsequent operations of fabricating the pack. Another important aspect is that the resulting pack should be suitable for enabling the product to be installed by automatic packaging systems.

OBJECTS AND SUMMARY OF THE INVENTION

An object of the present invention is to satisfy the above-specified requirements better than prior art packs.

To achieve this end, the present invention provides a pack for food, the pack being made from a single sheet of packaging material, wherein said sheet has a first zone in the form of a sector of a circle or an isosceles triangle including at least two rectilinear sides connected via two respective first score lines extending along said rectilinear sides of the first zone to two lateral zones in the form of two same-size rectangles, said sheet further including two non-intersecting cuts each intersecting both of said first score lines, each cut having two ends disposed in respective ones of each of said lateral zones, and two second score lines in respective ones of said lateral zones, interconnecting the ends of the cuts disposed therein, and means for fixing, after folding, each lateral zone portion delimited by the two cuts and by one each of the first and second score lines to the portion of the lateral zone that faces it after folding.

It will be understood that the cost of fabricating this pack is reduced since a single sheet of packaging material such as card can be used, with cuts being formed therein and with the previously cut and scored portions subsequently being folded.

It can also be seen that by having two cuts, a pack is obtained that is in the form of a sheet which encloses the product on both sides by means of its lateral zones and which also includes portions that correspond to the front face and to the rear face of the product. In addition, the folded strip extending between the two cuts is suitable for receiving printing for the purposes of commercializing the product.

The pack of the invention is particularly well suited to implementing a sheath for presenting a product which is itself in the form of a sector of a circle, e.g. a piece of cheese. Under such circumstances, the first zone is in the form of an isosceles triangle or of a sector of a circle, and the lateral zones are in the form of rectangles. In addition, the cuts are in the form of circular arcs centered on the apex of the triangle, thereby enabling the cheese to be inserted into the sheath between the non-folded portion of the base zone and the folded strip which is delimited by the two cuts. The two rectangular side zones constitute elements for protecting the sides of the cheese.

BRIEF DESCRIPTION OF THE DRAWING

Other characteristics and advantages of the present invention appear more clearly on reading the following description of an embodiment of the invention given by way of non-limiting example. The description refers to the accompanying figures, in which:

FIG. 1A is a partial view, similar to FIG. 1, showing an alternative embodiment of the invention; and.

MORE DETAILED DESCRIPTION

Figure 1:
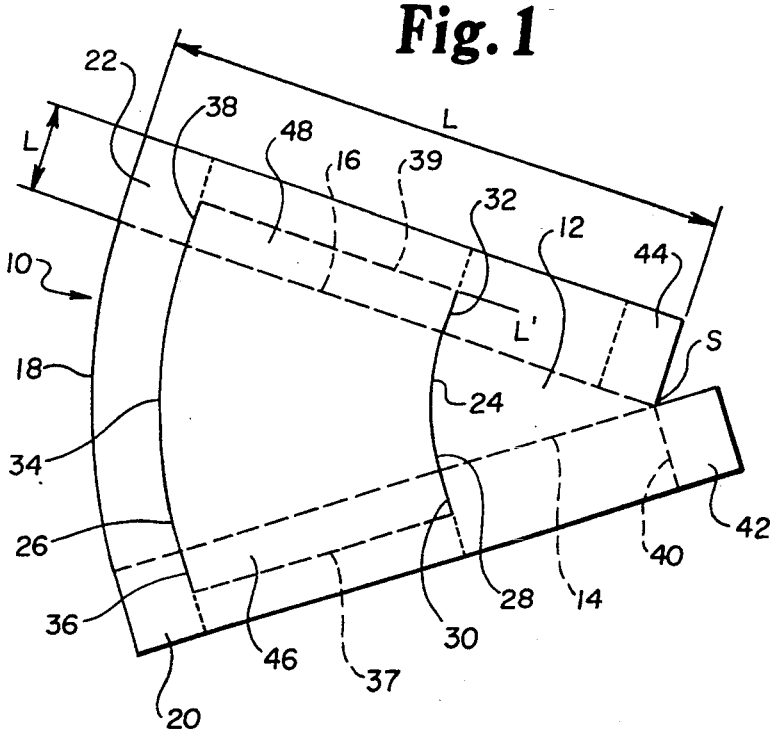
FIG. 1 is a plan view of a blank of packaging sheet material with its cuts and its score lines ready for making a pack.

With reference initially to FIG. 1, the description begins with the operations that enable the sheath, in particular of card or the like, to be formed into a blank which, after folding, serves to provide a pack of the invention.

The blank includes a first or base zone 12 which, in the example described with reference to the figures, is in the form of a sector of a circle. This zone is delimited by two rectilinear sides 14 and 16 which intersect at a point S constituting the center of the circular sector. The zone 12 is also delimited by a circular arc 18 centered on the point S. The blank 10 also includes two lateral zones given respective references 20 and 22, each being in the form of a rectangle having a long side of length L equal to the radius of the sector of the circle, and having a short side of length 1. Each of the lateral zones 20 and 22 is adjacent to a corresponding one of the sides 14 and 16 of the central zone 12. The zones 12, 20, and 22 form a single piece. The sides 14 and 16 also provide score lines for subsequent folding, enabling the lateral zones 20 and 22 to be folded perpendicularly to the base zone 12. The blank 10 also includes two cuts given respective references 24 and 26. Cut 24 is constituted by a circular arc 28 centered on the point S for its portion within the central zone 12, and by two rectilinear segments 30 and 32 extending into respective ones of the lateral zones 20 and 22. The length 1' of each of the segments 30 and 32 is preferably equal to one-half of the length 1 of a short side of the rectilinear lateral zones 20 and 22. The shape of cut 26 is similar to that of cut 24 and comprises a circular arc 34 centered on the point S, and two rectilinear segments 36 and 38 disposed in the lateral zones 20 and 22. The segments 36 and 38 of the cut 26 are likewise of length 1'. Within each of the lateral zones, the two ends of the cuts 24 and 26 are interconnected by second score lines given respective references 37 and 39. These second score lines extend parallel to the first score lines 14 and 16.

As shown in FIG. 1, the short side 40 of lateral zone 20 adjacent to the apex S is extended by a tongue 42 which is connected to the lateral zone 20 by a score line running along said short side 40. Preglued zones, e.g. using a thermosetting varnish, are provided firstly on the tongue 42 and on the corresponding portion 44 at the end of the other lateral zone 22, and secondly in zones 46 and 48.

The zones 46 and 48 are delimited by the rectilinear portions of the cuts 24 and 26 and by the score lines 37, 14, 16, and 39.

Figure 2:
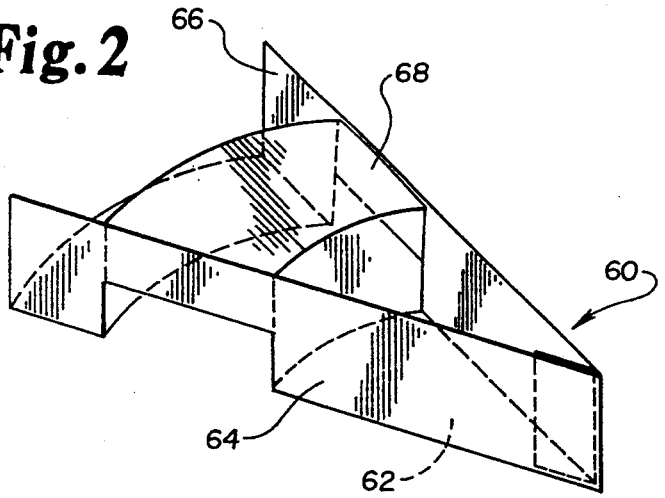
FIG. 2 is a perspective view of the pack made from the blank shown in FIG. 1 after it has been folded and glued.
Figure 1A:
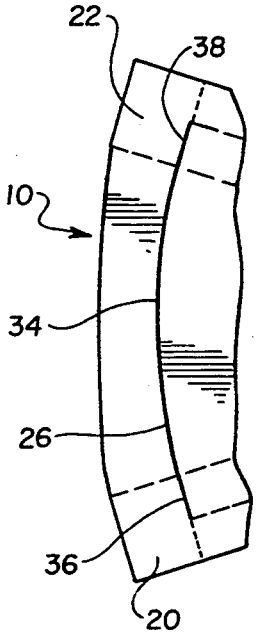

FIG. 2 shows the pack 60 that is obtained after the blank shown in FIG. 1 has been folded and stuck together. Overall, this produces a bottom 62 constituted by the remaining zone of the base zone 12 minus the strip defined by the cuts 24 and 26, two sides 64 and 66 constituted by the lateral zones, and a top strip 68 constituted by the portion of the base zone that extends between the two cuts 24 and 26. It will be understood that it is thus possible to insert food that is generally in the form of a sector of a circle, such as a piece of cheese, between the top strip 68 and the bottom 64, with the cheese being simultaneously confined by the sides 64 and 66.

In addition, the stiffness of the sides 64 and 66 is reinforced firstly by the tongue 42 being stuck to the end of the other lateral zone, and secondly by the zones 46 and 48 being stuck to the corresponding portions of the lateral zones. This stiffness is further increased by the fact that the strip 68 interconnects the free edges of the sides 64 and 66.

It can also be seen that the strip 68 which is placed on top of the packaged product is suitable for receiving commercial information for clearly designating the product and for displaying the printing that will help sell it.

I claim:

1. A pack for food, the pack being made from a single sheet of packaging material, wherein said sheet has a first zone in the form of a sector of a circle or an isosceles triangle including two rectilinear sides, the first zone connected, along two respective first score lines defining said rectilinear sides of the first zone, to two lateral zones in the form of two rectangles of the same size, said sheet further having formed therein two non-intersecting cuts, each cut intersecting said two first score lines, each cut having two opposite ends, each end terminating in a respective one of said lateral zones, and said sheet further including a second score line in each of said lateral zones, each second score line extending between corresponding ends of the cuts formed in said sheet, and means for fixing, after folding along said first and second score lines, a portion of each lateral zone, delimited by the two cuts and by corresponding first and second score lines, to a portion of the lateral zone against which it is engaged after folding.

2. A pack according to claim 1, in which each second score line is parallel to its corresponding first score line.

3. A pack according to claim 2, in which each of said second score lines is disposed substantially halfway between the corresponding first score line and the opposing free edge of the lateral zone in which it is contained.

4. A pack according to claim 3, in which said cuts are in the form of two circular arcs having a common point about which each arc is defined that coincides with the apex of said triangle or of said sector of a circle, each circular arc being extended, at each of its ends, by a respective rectilinear portion disposed in a corresponding lateral zone.

5. A pack according to claim 4, in which one of the lateral zones is extended at its end close to the apex of the triangle or the sector by a foldable tab provided with means for fixing to the corresponding portion of the other lateral zone, after folding.

6. A pack according to claim 1, in which said cuts are in the form of two circular arcs having a common point about which each arc is defined that coincides with the apex of said triangle or of said sector of a circle, each circular arc being extended, at each of its ends, by a respective rectilinear portion disposed in a corresponding lateral zone.

7. A pack according to claim 1, in which one of the lateral zones is extended at its end close to the apex of the triangle or the sector by a foldable tab provided with means for fixing to the corresponding portion of the other lateral zone, after folding.

* * * * *